US010472804B2

(12) United States Patent
Yamashita et al.

(10) Patent No.: US 10,472,804 B2
(45) Date of Patent: Nov. 12, 2019

(54) HYDRAULIC CONTROL SYSTEM OF CONSTRUCTION MACHINE

(71) Applicant: Hitachi Construction Machinery Co., Ltd., Taito-ku, Tokyo (JP)

(72) Inventors: Ryohei Yamashita, Tsuchiura (JP); Shinya Imura, Toride (JP); Kouji Ishikawa, Kasumigaura (JP); Hidekazu Moriki, Mito (JP); Hiroaki Amano, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 164 days.

(21) Appl. No.: 15/554,533

(22) PCT Filed: May 26, 2016

(86) PCT No.: PCT/JP2016/065643
§ 371 (c)(1),
(2) Date: Aug. 30, 2017

(87) PCT Pub. No.: WO2016/194783
PCT Pub. Date: Dec. 8, 2016

(65) Prior Publication Data

US 2018/0051444 A1 Feb. 22, 2018

(30) Foreign Application Priority Data

Jun. 1, 2015 (JP) ..... 2015-111733

(51) Int. Cl.
*E02F 9/22* (2006.01)
*F15B 11/044* (2006.01)
(Continued)

(52) U.S. Cl.
CPC ..... *E02F 9/2228* (2013.01); *E02F 9/226* (2013.01); *E02F 9/2253* (2013.01);
(Continued)

(58) Field of Classification Search
CPC ..... F15B 2211/6658; F15B 2211/86; F15B 2211/80; F15B 2211/87; F15B 2211/875;
(Continued)

(56) References Cited

U.S. PATENT DOCUMENTS

2011/0083750 A1 4/2011 Gehlhoff et al.
2012/0232756 A1* 9/2012 Yuan ..... E02F 9/226 701/41

FOREIGN PATENT DOCUMENTS

JP 11-95855 A 4/1999
JP 2004-76904 A 3/2004
(Continued)

OTHER PUBLICATIONS

International Preliminary Report on Patentability (PCT/IB/338 & PCT/IB/373) issued in PCT Application No. PCT/JP2016/065643 dated Dec. 14, 2017, including English translation of document C2 (Japanese-language Written Opinion (PCT/ISA/237)) previously filed on Aug. 30, 2017 (seven (7) pages).
(Continued)

*Primary Examiner* — Spencer D Patton
(74) *Attorney, Agent, or Firm* — Crowell & Moring LLP

(57) ABSTRACT

A hydraulic control system achieves a reduction in meter-out pressure loss in accordance with variation of a negative load acting on a hydraulic actuator. A hydraulic fluid discharged from the actuator flows through meter-out flow lines having variable restrictors. A load sensor detects the magnitude of a negative load applied to the actuator by an external force in the same direction as the operating direction of the actuator. A control device reduces the sum total of the opening areas of the variable restrictors in accordance with an increase in the magnitude of the negative load detected by the load sensor and the operation amount detected by the operation amount sensor when the load abnormality sensor does not detect any abnormality. When an abnormality is
(Continued)

detected, it reduces the sum total of the opening areas to a predetermined value in accordance with the operation amount detected by the operation amount sensor.

4 Claims, 8 Drawing Sheets

(51) Int. Cl.

| | |
|---|---|
| ***F15B 19/00*** | (2006.01) |
| ***F15B 11/04*** | (2006.01) |
| ***F15B 20/00*** | (2006.01) |
| ***F15B 11/10*** | (2006.01) |
| ***E02F 9/26*** | (2006.01) |

(52) U.S. Cl.
CPC ..... *E02F 9/2296* (2013.01); *E02F 9/268* (2013.01); *F15B 11/04* (2013.01); *F15B 11/044* (2013.01); *F15B 11/10* (2013.01); *F15B 19/005* (2013.01); *F15B 20/00* (2013.01); *E02F 9/2235* (2013.01); *F15B 2211/30565* (2013.01); *F15B 2211/31558* (2013.01); *F15B 2211/329* (2013.01); *F15B 2211/353* (2013.01); *F15B 2211/355* (2013.01); *F15B 2211/40515* (2013.01); *F15B 2211/41581* (2013.01); *F15B 2211/426* (2013.01); *F15B 2211/6313* (2013.01); *F15B 2211/6316* (2013.01); *F15B 2211/6355* (2013.01); *F15B 2211/665* (2013.01); *F15B 2211/6654* (2013.01); *F15B 2211/761* (2013.01); *F15B 2211/862* (2013.01)

(58) Field of Classification Search
CPC ..... F15B 2211/8752; F15B 2211/353; F15B 2211/355; F15B 2211/36; F15B 2211/40515; F15B 2211/6313; F15B 2211/6316; F15B 2211/6656; F15B 2211/6657; F15B 2211/6654; F15B 2211/761; F15B 2211/862; F15B 11/028; F15B 11/044; F15B 11/05; F15B 19/005; E02F 9/2221; E02F 9/2228
See application file for complete search history.

(56) References Cited

FOREIGN PATENT DOCUMENTS

| | | | |
|---|---|---|---|
| JP | 2004076904 A | * | 3/2004 |
| JP | 2006-177402 A | | 7/2006 |

OTHER PUBLICATIONS

International Search Report (PCT/ISA/210) issued in PCT Application No. PCT/JP2016/065643 dated Aug. 16, 2016 with English translation (3 pages).
Japanese-language Written Opinion (PCT/ISA/237) issued in PCT Application No. PCT/JP2016/065643 dated Aug. 16, 2016 (4 pages).
Extended European Search Report issued in counterpart European Application No. 16803218.3 dated Feb. 18, 2019 (eight (8) pages).

* cited by examiner

HYDRAULIC CONTROL SYSTEM OF CONSTRUCTION MACHINE

TECHNICAL FIELD

The present invention relates to a hydraulic control system of a construction machine.

BACKGROUND ART

A construction machine such as a hydraulic excavator is generally equipped with a hydraulic pump, a hydraulic actuator driven by a hydraulic fluid delivered from the hydraulic pump, and a flow control valve controlling the supply and discharge of the hydraulic fluid with respect to the hydraulic actuator. For example, in the case of a hydraulic excavator, the hydraulic actuators include a boom cylinder driving a boom of a front work device, an arm cylinder driving an arm, a bucket cylinder driving a bucket, a swing hydraulic motor for swinging a swing structure, a track hydraulic motor for traveling a track structure, etc., and a flow control valve is provided for each actuator. Further, each flow control valve has a meter-in restrictor and a meter-out restrictor. By the meter-in restrictor, the flow rate of the hydraulic fluid supplied from the hydraulic pump to the corresponding hydraulic actuator is controlled, and, by the meter-out restrictor, the flow rate of the hydraulic fluid discharged from the hydraulic actuator to a tank is controlled.

In a construction machine equipped with such hydraulic actuators, when the weight of the object of support of a hydraulic actuator (e.g., an arm and a bucket (attachment) in the case of an arm cylinder) acts as a load in the same direction as the operating direction of the hydraulic actuator (hereinafter also referred to as a "negative load"), the operating speed of the hydraulic actuator increases, and, as a result, there is a shortage of the flow rate of the meter-in side hydraulic fluid, resulting, in some cases, in generation of a breathing phenomenon (cavitation). As a result, there is a fear of the operability of the construction machine deteriorating.

To cope with this problem, there exists a hydraulic circuit in which there is provided a pilot type variable opening valve in a meter-out line branching off from a rod side line connected to the rod side of a hydraulic cylinder and communicating with a tank and in which the opening area of the variable opening valve is controlled in accordance with the rod side pressure (See, for example, Patent Document 1).

PRIOR ART DOCUMENT

Patent Document

Patent Document 1: JP-2006-177402-A

SUMMARY OF THE INVENTION

Problem to be Solved by the Invention

The requisite rod side pressure for supporting the above-mentioned negative load, that is, the meter-out pressure loss, is varied not only by the weight of the arm and attachment but also by the attitude of the arm. For example, when causing the arm to perform crowding operation in the air from an angle close to the horizontal direction to an angle close to the vertical direction with respect to the ground, directly after the starting of the expansion of the arm cylinder, that is, in a condition in which the angle of the arm is close to the horizontal direction, a high rod side pressure is required to support the negative load, whereas, in a condition in which the arm cylinder has expanded and in which the angle of the arm is close to the vertical direction, it is possible to support the negative load with a rod side pressure lower than that directly after the starting of the expansion.

In view of this, the present applicant and the present inventor have invented a hydraulic control system of the following construction, and filed a patent application thereon: A hydraulic control system includes: a control valve controlling the supply and discharge of a hydraulic fluid with respect to a hydraulic actuator; an operation lever operating the position of a spool of the control valve; a meter-out flow line through which the hydraulic fluid discharged from the hydraulic actuator flows; a variable restrictor provided in the meter-out flow line; a pressure sensor detecting the magnitude of a negative load acting on the hydraulic actuator; and a pressure sensor for detecting an operation amount of the operation lever. The spool position of the control valve is moved in accordance with the magnitude of the negative load detected and the operation amount of the operation lever. The opening area of the variable restrictor is controlled. In this hydraulic control system, in the case, for example, where the magnitude of the negative load increases, control is performed so as to reduce the opening area of the variable restrictor.

However, in the hydraulic control system of the above-described construction, if a failure or an abnormal condition is generated in the pressure sensor detecting the magnitude of the negative load acting on the hydraulic actuator, the magnitude of the negative load cannot be detected accurately, so that it is to be expected that it is impossible to reduce the opening area of the variable restrictor to a magnitude small enough to support the negative load. As a result, a breathing phenomenon arises to deteriorate the operability, and, in the worst case, there is a fear of the hydraulic apparatus being damaged.

The present invention has been made in view of the above circumstances. It is an object of the present invention to provide a hydraulic control system of a construction machine capable of reducing the meter-out pressure loss in accordance with the variation of the negative load acting on the hydraulic actuator and capable of preventing deterioration in operability and damage of the hydraulic apparatus even when a failure or an abnormal condition arises in the pressure sensor detecting the magnitude of the negative load.

Means for Solving the Problem

To achieve the above object, there are provided, according to a first aspect of the invention, a hydraulic actuator driven by a hydraulic fluid delivered from a hydraulic pump; one or a plurality of meter-out flow lines through which the hydraulic fluid discharged from the hydraulic actuator flows; one variable restrictor provided in the one meter-out flow line, or a plurality of variable restrictors each provided in the plurality of meter-out flow lines; an operation device outputting an operation command signal for the hydraulic actuator in accordance with an operation amount; an operation amount sensor detecting an operation amount of the operation device; a load sensor detecting the magnitude of a negative load which is a load applied to the hydraulic actuator by an external force and which is a load in the same direction as the operating direction of the hydraulic actuator;

a load abnormality sensor detecting a failure or an abnormal condition of the load sensor; and a control device which, when the load abnormality sensor does not detect a failure or an abnormal condition of the load sensor, reduces the opening area of the one variable restrictor provided in the one meter-out flow line or the sum total of the opening areas of the plurality of variable restrictors each provided in the plurality of meter-out flow lines in accordance with an increase in the magnitude of a negative load detected by the load sensor and the operation amount detected by the operation amount sensor and which, when the load abnormality sensor detects a failure or an abnormal condition of the load sensor, reduces the opening area of the one variable restrictor or the sum total of the opening areas of the plurality of variable restrictors to a predetermined value in accordance with the operation amount detected by the operation amount sensor.

Effect of the Invention

According to the present invention, it is possible to provide a hydraulic control system of a construction machine capable of preventing deterioration in operability and damage of the hydraulic apparatus even when a failure or an abnormal condition arises in a pressure sensor detecting the magnitude of a negative load.

MODES FOR CARRYING OUT THE INVENTION

In the following, embodiments of the present invention will be described with reference to the drawings, taking a hydraulic excavator as an example of the construction machine.

Embodiment 1

Figure 1:
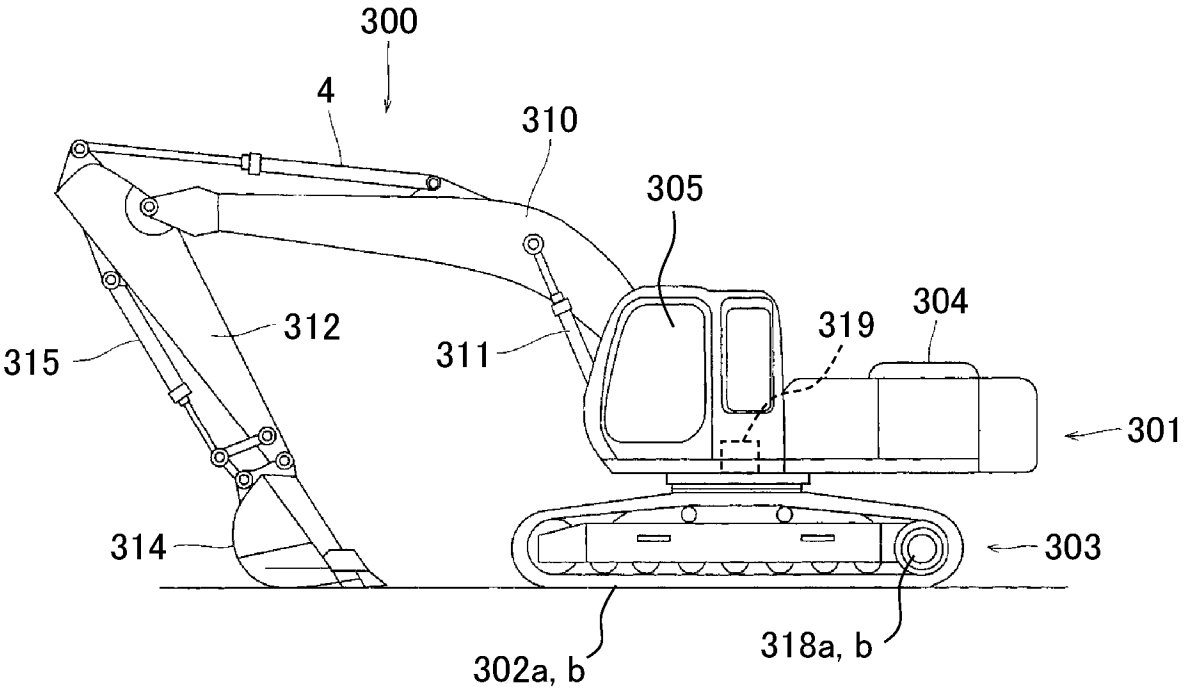
FIG. 1 is a side view of a hydraulic excavator equipped with a hydraulic control system of a construction machine according to a first embodiment of the present invention.

FIG. 1 is a side view of a hydraulic excavator equipped with a hydraulic control system of a construction machine according to the first embodiment of the present invention.

In FIG. 1, a hydraulic excavator 301 is equipped with a track structure 303 equipped with a pair of right and left crawlers 302*a* and 302*b*, a swing structure 304 swingably provided above the track structure 303, and a multi joint type operation device 300 one end of which is connected to the swing structure 304.

Mounted on the track structure 303 are track hydraulic motors 318*a* and 318*b* driving the crawlers 302*a* and 302*b*. At the central portion of the swing structure 304, there is provided a swing hydraulic motor 319 swinging the swing structure 304. On the front left side of the swing structure 304, there is installed an operation room 305 accommodating an operation lever (operation device) 6 (See FIG. 2). The operation device 300 is mounted to the front central portion of the swing structure 304.

The operation device 300 is equipped with a boom 310 vertically swingably mounted to a boom foot provided at the front central portion of the swing structure 304, an arm 312 mounted to the distal end of the boom 310 so as to be swingable in the front-rear direction, and a bucket 314 that is a work tool (attachment) mounted to the distal end of the arm 312 so as to be vertically rotatable.

Further, the operation device 300 has a boom cylinder (hydraulic cylinder) 311 connected to the boom foot and the boom 310 and causing the boom 310 to swing in the vertical direction, an arm cylinder (hydraulic cylinder) 4 connected to the boom 310 and the arm 312 and causing the arm 312 to swing in the vertical direction, and a bucket cylinder (hydraulic cylinder) 315 connected to the arm 312 and the work tool 314 and causing the bucket 314 to rotate in the vertical direction. That is, the operation device 300 is driven by these hydraulic cylinders 311, 4, and 315.

Figure 2:
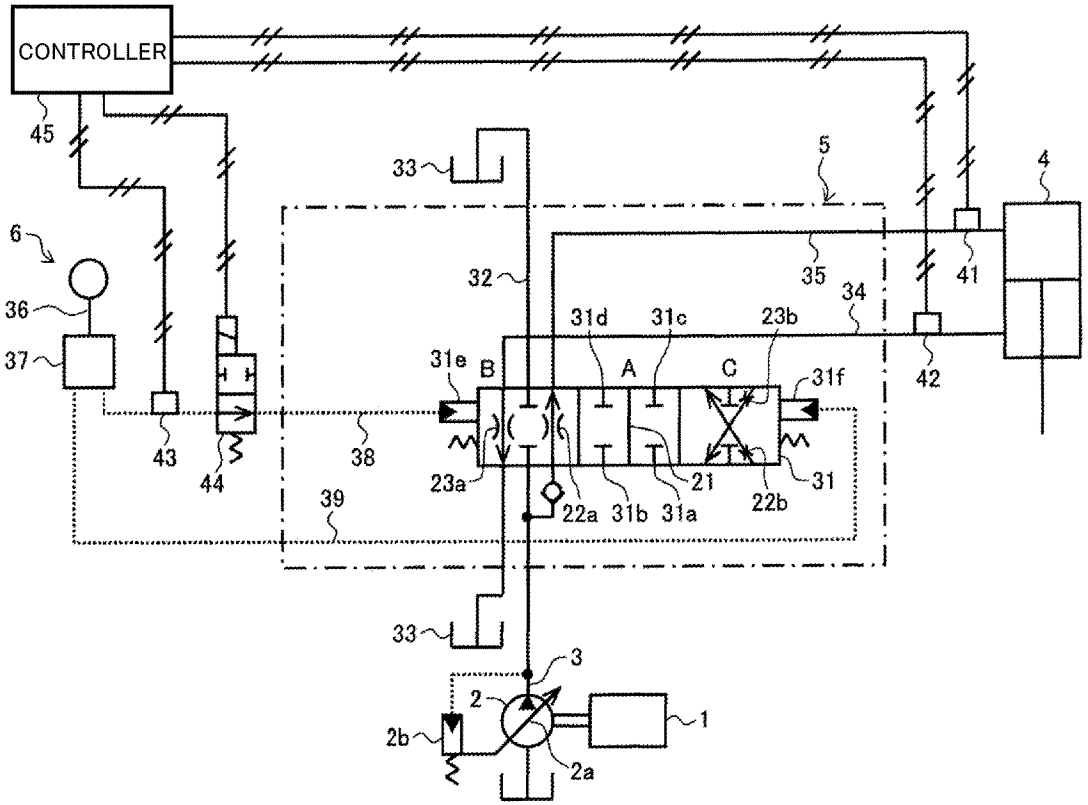
FIG. 2 is a conceptual drawing illustrating a control/hydraulic circuit related to an arm cylinder in the hydraulic control system of the construction machine according to the first embodiment of the present invention.

FIG. 2 is a conceptual drawing illustrating a control/hydraulic circuit related to the arm cylinder in the hydraulic control system of the construction machine according to the first embodiment of the present invention. In FIG. 2, the hydraulic control system according to the present embodiment is equipped with a prime mover 1, a hydraulic pump 2 driven by this prime mover 1, a valve device 5 connected to a delivery line 3 of the hydraulic pump 2 and having an arm control valve 31 controlling the flow rate and direction of the hydraulic fluid supplied to the arm cylinder 4, and a pilot valve 6 that is an operation lever device for the arm.

The hydraulic pump 2 is of the variable displacement type, and has a displacement volume varying member, e.g., a swash plate 2*a*, and the swash plate 2*a* is controlled by a horsepower control actuator 2*b* so as to reduce the volume as the delivery pressure of the hydraulic pump 2 increases.

The control valve 31 is of the center bypass type, and a center bypass portion 21 is situated in a center bypass line 32. The upstream side of the center bypass line 32 is connected to the delivery line 3 of the hydraulic pump 2, and the downstream side thereof is connected to a tank 33. Further, the control valve 31 has a pump port 31*a*, a tank port 31*b*, and actuator ports 31*c* and 31*d*. The pump port 31*a* is connected to the center bypass line 32. The tank port 31*b* is connected to the tank 33, and the actuator ports 31*c* and 31*d* are connected to a bottom side hydraulic chamber and a rod side hydraulic chamber of the arm cylinder 4 via actuator lines 35 and 34.

The pilot valve 6 has an operation lever 36 and a pilot pressure generating portion 37 containing a pair of pressure reducing valves (not shown), and the pilot pressure generating portion 37 is connected to pilot pressure receiving portions 31*e* and 31*f* of the control valve 31 via pilot lines 38 and 39. When the operation lever 36 is operated, the designated pilot pressure generating portion 37 operates on of the pair of pressure reducing valves in accordance with the operating direction thereof, outputting a pilot pressure corresponding to the operation amount to one of the pilot lines 38 and 39.

The control valve 31 has a neutral position A and switching positions B and C, and when the pilot pressure is imparted to the pressure receiving portion 31*e* by the pilot line 38, switching is effected to the switching position B on the left-hand side as seen in the drawing. At this time, the actuator line 35 is on the meter-in side, and the actuator line 34 is on the meter-out side, and the hydraulic fluid is supplied to the bottom side hydraulic chamber of the arm cylinder 4, expanding the piston rod of the arm cylinder 4.

On the other hand, when the pilot pressure is imparted to the pressure receiving portion 31*f* by the pilot line 39, switching is effected to the position C on the right-hand side as seen in the drawing. At this time, the actuator line 34 is on the meter-in side, and the actuator line 35 is on the meter-out side, and the hydraulic fluid is supplied to the rod side hydraulic chamber of the arm cylinder 4, contracting the piston rod of the arm cylinder 4. The expansion of the piston rod of the arm cylinder 4 corresponds to the arm drawing-in operation, that is, the crowding operation, and the contraction of the piston rod of the arm cylinder 4 corresponds to the arm pushing-out operation, that is, the damping operation.

Further, the control valve 31 has meter-in restrictors 22*a* and 22*b* and meter-out restrictors 23*a* and 23*b*. When the control valve 31 is at the switching position B, the flow rate of the hydraulic fluid supplied to the arm cylinder 4 is controlled by the meter-in restrictor 22*a*, and the flow rate of the return hydraulic fluid from the arm cylinder 4 is controlled by the meter-out restrictor 23*a*. On the other hand, when the control valve 31 is at the switching position C, the flow rate of the hydraulic fluid supplied to the arm cylinder 4 is controlled by the meter-in restrictor 22*b*, and the flow rate of the return hydraulic fluid from the arm cylinder 4 is controlled by the meter-out restrictor 23*b*.

The hydraulic control system of the construction machine according to the first embodiment of the present invention is characterized in that it includes a pressure sensor 41 detecting the pressure of the bottom side hydraulic chamber of the arm cylinder 4, a pressure sensor 42 detecting the pressure of the rod side hydraulic chamber of the arm cylinder 4, a pressure sensor 43 detecting an arm crowding pilot pressure output by the pilot valve 6, a solenoid proportional valve 44 arranged in the pilot line 38, and a controller 45 inputting the detection signals of the pressure sensor 41, the pressure sensor 42, and the pressure sensor 43, performing predetermined computation processing, and outputting a command electric current to the solenoid proportional valve 44.

Figure 3:
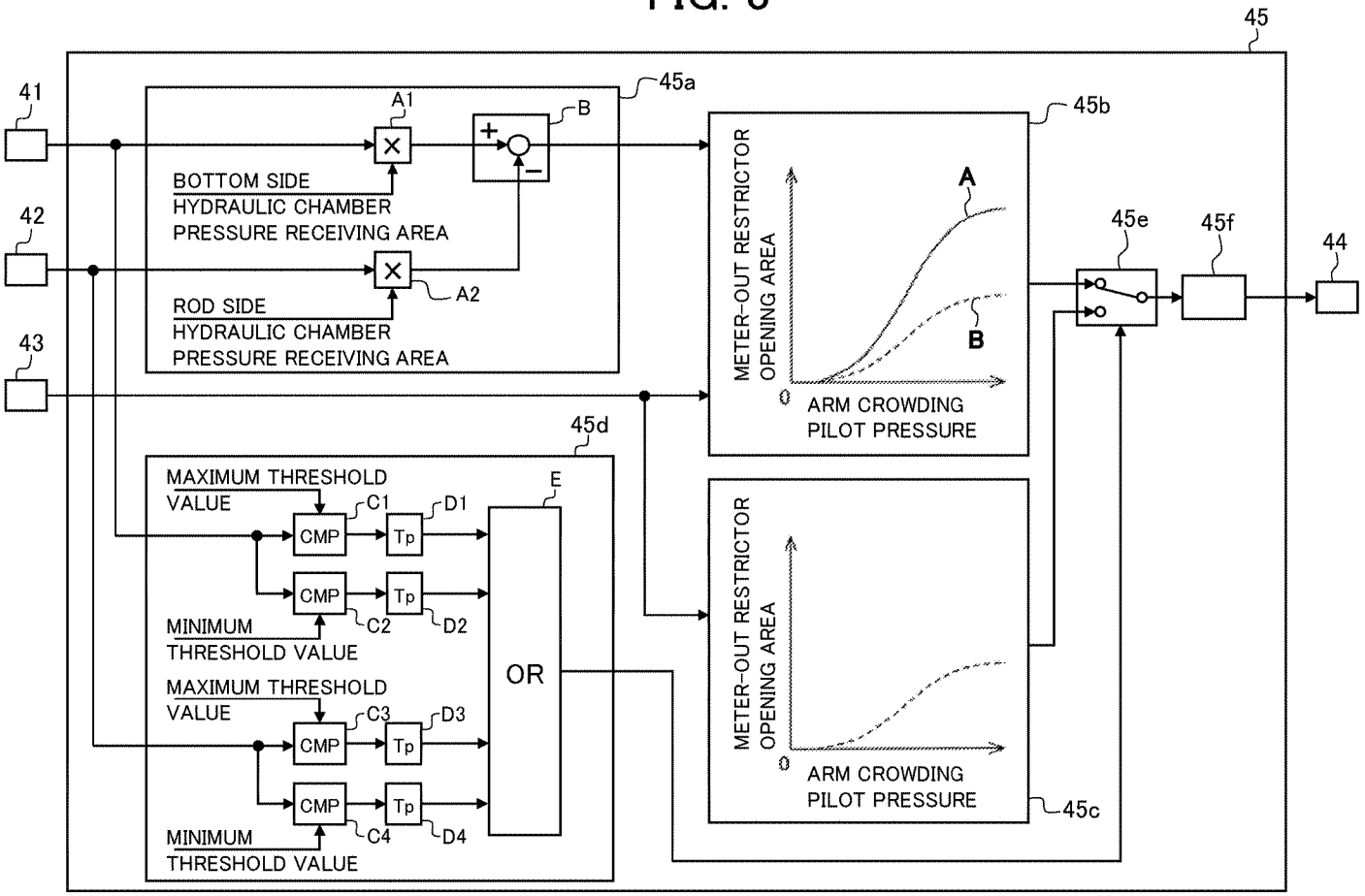
FIG. 3 is a functional block diagram illustrating the processing function of a controller constituting the hydraulic control system of the construction machine according to the first embodiment of the present invention.

Next, the processing by the controller according to the present embodiment will be described with reference to FIG. 3. FIG. 3 is a functional block diagram illustrating the processing function of the controller constituting the hydraulic control system of the construction machine according to the first embodiment of the present invention.

The controller 45 is equipped with an arm cylinder load computation section 45*a*, a first meter-out opening computation section 45*b*, a second meter-out opening computation section 45*c*, a cylinder pressure sensor failure detection section 45*d*, an output selection section 45*e*, and a solenoid electric current computation section 45*f*.

The arm cylinder load computation section 45*a* inputs the pressure signal of the bottom side hydraulic chamber of the arm cylinder 4 detected by the pressure sensor 41, and the pressure signal of the rod side hydraulic chamber of the arm cylinder 4 detected by the pressure sensor 42, and subtracts the product of the pressure signal of the rod side hydraulic chamber of the arm cylinder 4 and the pressure receiving area of the rod side hydraulic chamber from the product of the pressure signal of the bottom side hydraulic chamber of the arm cylinder 4 and the pressure receiving area of the bottom side hydraulic chamber, thereby calculating the load of the arm cylinder 4.

More specifically, there are provided: a first multiplier A1 inputting the pressure signal of the bottom side hydraulic chamber of the arm cylinder 4 detected by the pressure sensor 41 as a first input, inputting a signal corresponding to the pressure receiving area of the bottom side hydraulic chamber as a second input, and outputting the result of the multiplication of the first input and the second input; a second multiplier A2 inputting the pressure signal of the rod side hydraulic chamber of the arm cylinder 4 detected by the pressure sensor 42 as a first input, inputting a signal corresponding to the pressure receiving area of the rod side hydraulic chamber as a second input, and outputting the result of the multiplication of the first input and the second input; and a subtractor B inputting the output signal of the first multiplier A1 as a first input, inputting the output signal of the second multiplier A2 as a second input, and outputting the result of the subtraction of the second input from the first input. The calculated load signal of the arm cylinder 4 is output to the first meter-out opening computation section 45*b*.

The arm cylinder load computation section 45*a* operates such that, when, for example, a load in a direction opposite to the direction in which the piston rod of the arm cylinder 4 extends acts as in the case of excavating, the output of the first multiplier A1, which is the product of the pressure signal of the bottom side hydraulic chamber and the pressure receiving area of the bottom side hydraulic chamber, is larger than the output of the second multiplier A2, which is the product of the pressure signal of the rod side hydraulic chamber and the pressure receiving area of the rod side hydraulic chamber, and the output of the subtractor B, which is the result of the subtraction, is positive, with a positive load being calculated as the load of the arm cylinder 4.

On the other hand, when a load in the same direction as the direction in which the piston rod of the arm cylinder 4 extends acts as in the case of the load due to the weight of the arm and attachment, the output of the first multiplier A1, which is the product of the pressure signal of the bottom side hydraulic chamber and the pressure receiving area of the bottom side hydraulic chamber, is smaller than the output of the second multiplier A2, which is the product of the pressure signal of the rod side hydraulic chamber and the pressure receiving area of the rod side hydraulic chamber, and the output of the subtractor B, which is the result of the subtraction, is negative, with a negative load being calculated as the load of the arm cylinder 4.

The first meter-out opening computation section 45*b* inputs the arm crowding pilot pressure signal detected by the pressure sensor 43, and the load of the arm cylinder 4 calculated by the arm cylinder load computation section 45*a*, and calculates the target opening area of the meter-out restrictor 23*a* in accordance with the load of the arm cylinder 4 and the arm crowding pilot pressure by using the table shown in FIG. 3. The calculated target opening area signal of the meter-out restrictor 23*a* is output to the output selection section 45*e*.

In the table of the first meter-out opening computation section 45*b*, the characteristic A indicated by the solid line indicates the characteristic (maximum value) of the target opening area signal of the meter-out restrictor 23*a* in accordance with the arm crowding pilot pressure when the load signal of the arm cylinder 4 calculated by the arm cylinder load computation section 45*a* is positive. When the load signal is positive, this characteristic does not depend on the magnitude thereof. On the other hand, the characteristic B indicated by the dashed line indicates the characteristic (minimum value) of the target opening area signal of the meter-out restrictor 23*a* in accordance with the arm crowding pilot pressure when the load signal of the arm cylinder 4 calculated by the arm cylinder load computation section 45*a* is negative and the absolute value thereof is maximum. When the arm crowding pilot pressure is the same, the characteristic B corresponds to the case where the load signal of the arm cylinder 4 is negative and where the absolute value is maximum. As the absolute value is reduced, there exists a characteristic line indicating an increase in the target opening area signal of the meter-out restrictor 23*a* in the direction of the characteristic A.

In other words, under a fixed arm crowding pilot pressure, when the load signal of the arm cylinder 4 is negative, and the absolute value is maximum, the target opening area signal of the meter-out restrictor 23*a* is reduced to the minimum value. As the absolute value is reduced, the target opening area signal of the meter-out restrictor 23*a* is increased in the direction of the characteristic A.

The second meter-out opening computation section 45*c* inputs the arm crowding pilot pressure signal detected by the pressure sensor 43, and calculates the target opening area of the meter-out restrictor 23*a* in accordance with the arm crowding pilot pressure by using the table shown in FIG. 3. The calculated target opening area signal of the meter-out restrictor 23*a* is output to the output selection section 45*e*. Further, the characteristic in the table of the second meter-out opening computation section 45*c* is the same as the characteristic B of the first meter-out opening computation section 45*b*, and indicates the characteristic (minimum value) of the target opening area signal of the meter-out restrictor 23*a* in accordance with the arm crowding pilot pressure.

The cylinder pressure sensor failure detection section 45*d* inputs the pressure signal of the bottom side hydraulic chamber of the arm cylinder 4 detected by the pressure sensor 41, and the pressure signal of the rod side hydraulic chamber of the arm cylinder 4 detected by the pressure sensor 42, and compares the values of these pressure signals with the maximum threshold value and the minimum threshold value. When a condition in which the threshold value is exceeded has continued a fixed period of time, it determines that the cylinder pressure sensor is in a failure/an abnormal condition. For example, when disconnection of the circuit or contact failure of the connection portion arises, the output voltage of the sensor is a minimum voltage, and when the circuit is short-circuited, it is to be expected that the output voltage of the sensor is a maximum voltage. Thus, when the threshold value is exceeded, and this condition continues for a fixed period of time, it is determined that the system is in a failure/an abnormal condition.

More specifically, there are provided a first comparator C1 which inputs as a first input the pressure signal of the bottom side hydraulic chamber of the arm cylinder 4 detected by the pressure sensor 41 and which inputs the maximum threshold value as a second input, a second comparator C2 which is of the same first input as the first comparator C1 and which inputs the minimum threshold value as a second input, a third comparator C3 which inputs the pressure signal of the rod side hydraulic chamber of the arm cylinder 4 detected by the pressure sensor 42 as the first input and which inputs the maximum threshold value as the second input, a fourth comparator C4 which is of the same first input as the third comparator C3 and which inputs the minimum threshold value as the second input, a first time computing unit (timer) D1 which inputs the output signal of the first comparator A1, a second time computing unit (timer) D2 which inputs the output signal of the second comparator C2, a third time computing unit (timer) D3 which inputs the output signal of the third comparator C3, a fourth time computing unit (timer) D4 which inputs the output signal of the fourth comparator C4, and a logical sum computing unit E which inputs the output signals of the first through fourth time computing units D1 through D4.

Here, the first comparator C1 and the third comparator C3 output a digital output signal 1 when the first input exceeds the second input, which is the threshold value. The second comparator C2 and the fourth comparator C4 output the digital output signal 1 when the first input is less than the second input, which is the threshold value. The first through fourth time computing units D1 through D4 output the digital output signal 1 after the elapse of a predetermined time after the input of the input signal. The logical sum computing unit E outputs the digital output signal 1 when one of the four signals input is 1. The calculated digital output signal is output to the output selection section 45*e*.

The output selection section 45*e* inputs the output signal of the first meter-out opening computation section 45*b* as the first input, and inputs the output signal of the second meter-out opening computation section 45*c* as the second input, inputting the digital output signal from the logical sum computing unit C of the cylinder pressure sensor failure detection section 45*d* as a switching signal. When the digital output signal, which is the switching signal, is 1, the output selection section 45*e* outputs the output signal of the second meter-out opening computation section 45*c*, which is the second input, as the output signal. When the digital output signal from the logical sum computing unit E of the switching signal input is 0, it outputs the output signal of the first meter-out opening computation section 45*b*, which is the first input. The output signal of the output selection section 45*e* is input to a solenoid electric current computation section 45*f*.

The solenoid electric current computation section 45*f* inputs from the output selection section 45*e* the target opening area of the meter-out restrictor 23*a* calculated by the first meter-out opening computation section 45*b* or the second meter-out opening computation section 45*c*, and calculates a solenoid electric current value in accordance with the input value, outputting it to the solenoid proportional valve 44 as a control signal.

Figure 4:
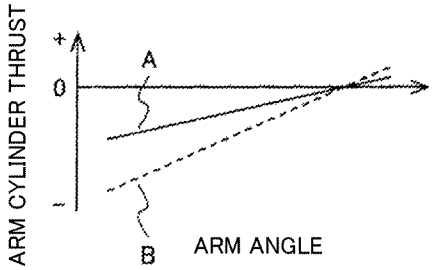
FIG. 4 is a characteristic chart illustrating the relationship between an arm angle and a load acting on an arm cylinder when crowding is performed on the arm in the air from an angle close to the horizontal direction with respect to the ground to the vertical direction in the hydraulic control system of the construction machine according to the first embodiment of the present invention.
Figure 5:
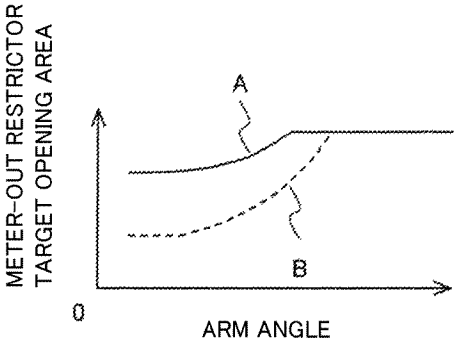
FIG. 5 is a characteristic chart illustrating the relationship between the arm angle and the target opening area of a meter-out restrictor 23*a* when crowding is performed on the arm in the air from an angle close to the horizontal direction with respect to the ground to the vertical direction in the hydraulic control system of the construction machine according to the first embodiment of the present invention.

Next, the operation of the hydraulic control system of the construction machine according to the first embodiment of the present invention will be described with reference to FIGS. 4 and 5. FIG. 4 is a characteristic chart illustrating the relationship between an arm angle and a load acting on the arm cylinder when crowding is performed on the arm in the air from an angle close to the horizontal direction with respect to the ground to the vertical direction in the hydraulic control system of the construction machine according to the first embodiment of the present invention, and FIG. 5 is a characteristic chart illustrating the relationship between the arm angle and the target opening area of the meter-out restrictor when crowding is performed on the arm in the air from an angle close to the horizontal direction with respect to the ground to the vertical direction in the hydraulic control system of the construction machine according to the first embodiment of the present invention.

In the following description, the state in which the pressure sensors 41 and 42 are in the normal condition and the state in which a failure or an abnormal condition has arisen in one or both of the pressure sensors 41 and 42 will be compared with each other.

First, the operation in the case where the pressure sensors 41 and 42 are in the normal condition will be described. The arm angle indicated by the horizontal axis of FIG. 4 is the angle of an arm 312 with respect to the horizontal plane. Suppose that the state in which the arm 312 is maintained horizontal in the air with respect to the ground corresponds to 0 degrees, and that the state in which the arm 312 is maintained vertical with respect to the horizontal plane after the expansion of the arm cylinder 4 and the counterclockwise rotation in FIG. 1 of the arm 312 corresponds to 90 degrees.

In FIG. 4, the characteristic A indicated by the solid line indicates the load of the arm cylinder 4 in the case where a standard bucket is attached, and the characteristic B indicated by the dashed line indicates the load of the arm cylinder 4 in the case where an attachment heavier than the standard bucket is attached. In both cases, in the state in which the arm angle is close to 0 degrees (horizontal), the load of the arm cylinder is a negative load due to the weight of the arm 312 and of the attachment, whereas as the arm angle approaches vertical, the absolute value of the negative load is reduced, and the load becomes positive at a position close to vertical.

FIG. 5 shows the relationship between the arm angle at this time and the target opening area signal of the meter-out restrictor 23*a* calculated by the first meter-out opening computation section 45*b* of the controller 45. In FIG. 5, the characteristic A indicated by the solid line indicates the target opening area of the meter-out restrictor 23*a* in the case where the standard bucket is attached, and the characteristic B indicated by the dashed line indicates the target opening area of the meter-out restrictor 23*a* in the case where an attachment heavier than the standard bucket is attached.

In the case where the standard bucket is attached, in the state in which the arm angle is close to 0 degrees (horizontal), the target opening area of the meter-out restrictor 23*a* is restricted, whereas, as the arm angle approaches vertical, it increases, and attains a maximum value. Here, this maximum value corresponds to the opening area characteristic of the characteristic A indicated by the solid line of the first meter-out opening computation section 45*b* of FIG. 3.

In the case where an attachment heavier than the standard bucket is attached, in the state in which the arm angle is close to 0 degrees (horizontal), the target opening area of the meter-out restrictor 23*a* is the minimum value, whereas, as the arm angle approaches vertical, it increases, and attains a maximum value. Here, this minimum value corresponds to the opening area characteristic of the characteristic B indicated by the dashed line of the first meter-out opening computation section 45*b* of FIG. 3.

In this way, in the present embodiment, the target opening area of the meter-out restrictor 23*a* is varied in accordance with the load of the arm cylinder 4, so that it is possible to reduce the meter-out pressure loss, and it is also possible to reduce the energy loss.

Here, to facilitate the understanding of the present embodiment, a case will be described where, in the controller 45 shown in FIG. 3, the second meter-out opening computation section 45*c*, the cylinder pressure sensor failure detection section 45*d*, and the output selection section 45*e* are not provided, and where a failure or an abnormal condition has arisen in the pressure sensor.

For example, in the case where the output of the pressure sensor 41 attains a maximum and fixed level independently of the actual detection pressure, the load signal of the arm cylinder calculated by the arm cylinder load computation section 45*a* shown in FIG. 3 is always a positive load, so that the opening area characteristic of the characteristic A indicated by the solid line is output as the target opening area signal of the meter-out restrictor 23*a* calculated by the first meter-out opening computation section 45*b*.

In this situation, when crowding is performed on the arm in the air from an angle close to horizontal with respect to the ground to vertical, a reduction is not effected to the requite opening area for the opening area of the meter-out restrictor 23*a* to support the negative load as shown in FIG. 5 although a negative load is acting in the state in which the arm angle is actually close to 0 degrees (horizontal) as shown in FIG. 4. As a result, there is generated a breathing phenomenon, and there is a fear of deterioration in operability and damage of the arm cylinder 4 and the valve device 5. The hydraulic control system of the construction machine of the present invention aims to prevent deterioration in operability and damage of the hydraulic apparatus even in such a failure/an abnormal condition of the pressure sensor.

A case will be described with reference to FIG. 3 in which a failure or an abnormal condition has arisen in one or both of the pressure sensors 41 and 42 in the hydraulic control system of the construction machine according to the first embodiment of the present invention.

For example, in the case where the output of the pressure sensor 41 has attained a maximum and fixed level independently of the actual detection pressure, the first input of the first comparator C1 of the cylinder pressure sensor failure detection section 45*d* exceeds the second input, which is the maximum threshold value, so that the digital output signal 1 is output, and is input to the first time computing unit D1.

The first time computing unit D1 outputs the digital output signal to the logical sum computing unit E after the elapse of a predetermined period of time since the input of the input signal. The digital output signal 1 is output to the output selection section 45*e* from the logical sum computing unit E.

Since the digital output signal 1, which is a switching signal, has been input, the output selection section 45*e* switches the output signal from the output signal of the first meter-out opening computation section 45*b*, which is the first input, to the output signal of the second meter-out opening computation section 45*c*, which is the second input. The output signal is then output to the solenoid electric current computation section 45*f*, and the solenoid electric current computation section 45*f* calculates a solenoid electric current value in accordance with the input value, and controls the solenoid proportional valve 44.

In the table of the second meter-out opening computation section 45*c*, there is set the characteristic (minimum value) of the target opening area signal of the meter-out restrictor 23*a* in accordance with the arm crowding pilot pressure that is the same as the characteristic B of the first meter-out opening computation section 45*b*, so that, even in the case of a condition in which the absolute value of the negative load acting on the arm cylinder 4 is maximum, for example, even when the arm to which a heavy attachment is attached assumes an attitude close to horizontal with respect to the ground, the opening area of the meter-out restrictor 23*a* is reduced to the requisite opening area for supporting the negative load, so that no breathing phenomenon arises.

In this way, when a failure or an abnormal condition has arisen in one or both of the pressure sensors 41 and 42, the opening area of the meter-out restrictor 23*a* is controlled based on the operation amount of the operation lever 36, so that it is possible to prevent deterioration in operability when a negative load acts on the arm cylinder 4.

In the hydraulic control system of the construction machine according to the first embodiment of the present invention, even when a failure or an abnormal condition arises in the pressure sensors 41 and 42 detecting the magnitude of a negative load, it is possible to provide a hydraulic control system of a construction machine capable of preventing deterioration in operability and damage of the hydraulic apparatus.

Embodiment 2

Figure 6:
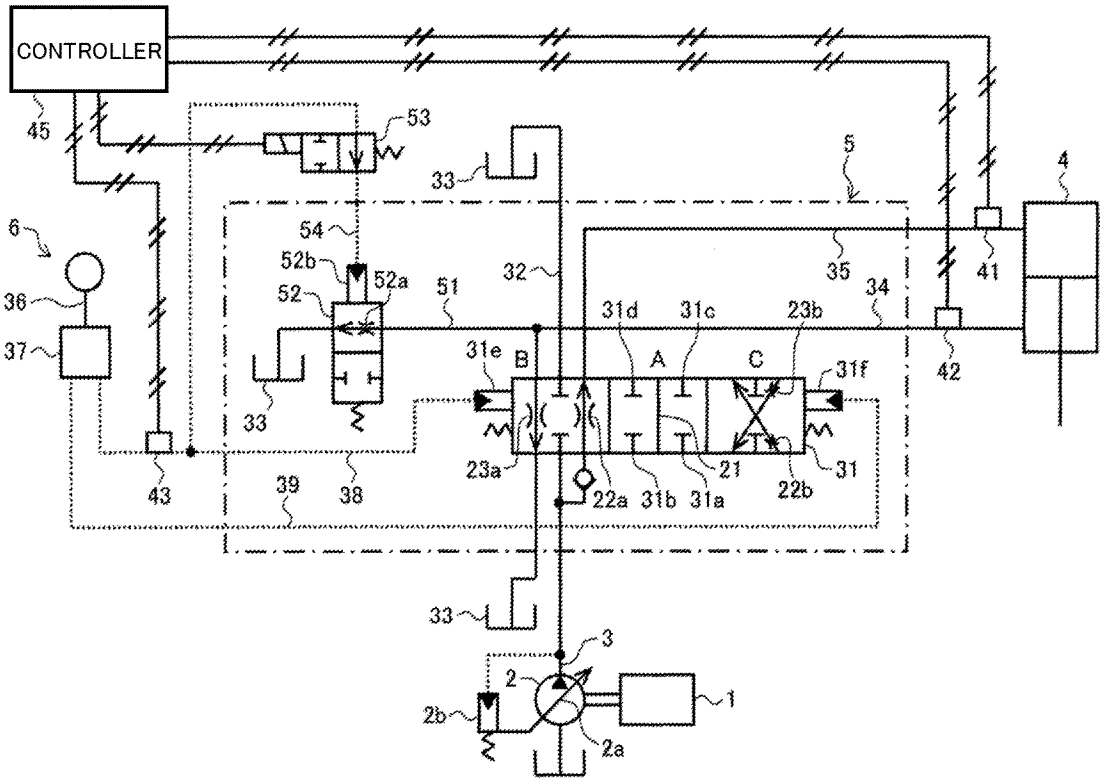
FIG. 6 is a conceptual drawing illustrating a control/hydraulic circuit related to an arm cylinder in a hydraulic control system of a construction machine according to a second embodiment of the present invention.
Figure 7:
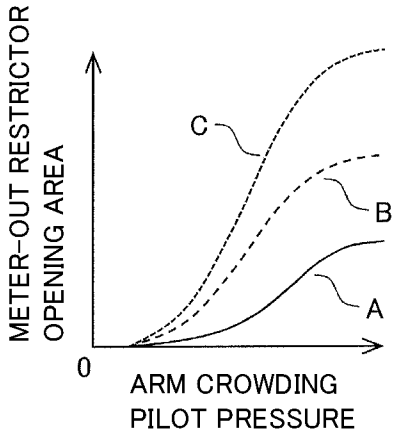
FIG. 7 is a characteristic chart illustrating the opening area characteristic of meter-out restrictors 52*a* and 23*a* in the hydraulic control system of the construction machine according to the second embodiment of the present invention.

In the following, a hydraulic control system of a construction machine according to the second embodiment of the present invention will be described with reference to the drawings. FIG. 6 is a conceptual drawing illustrating a control/hydraulic circuit related to an arm cylinder in the hydraulic control system of the construction machine according to the second embodiment of the present invention, and FIG. 7 is a characteristic chart illustrating the opening area characteristic of meter-out restrictors 52*a* and 23*a* in the hydraulic control system of the construction machine according to the second embodiment of the present invention. In FIGS. 6 and 7, the same portions as those of FIGS. 1 through 5 are indicated by the same reference numerals, and a detailed description thereof will be left out.

In the hydraulic control system of the construction machine according to the second embodiment of the present invention, the system of the control/hydraulic circuit is roughly the same as that of the first embodiment, and it differs from the first embodiment in that the solenoid proportional valve 44 arranged in the pilot line 38 is omitted, that there is provided a meter-out branching-off line 51 branching off from the meter-out side actuator line 34 at the time of the arm crowding request and connected to the tank 33, that a meter-out control valve 52 is arranged in the meter-out branching-off line 51, and that there is provided a solenoid proportional valve 53 for effecting the switching of the spool position of the meter-out control valve 52.

The meter-out control valve 52 is a 2-port/2-position valve, and is equipped with a meter-out restrictor 52*a* and a pressure receiving portion 52*b*. The pressure receiving portion 52*b* is connected to an arm crowding command side pilot line 38 via a signal pressure line 54. A solenoid proportional valve 53 is arranged in the signal pressure line 54.

The solenoid proportional valve 53 reduces the arm crowding pilot pressure in accordance with a command electric current output from the controller 45, and outputs the signal pressure to the pressure receiving portion 52*b*.

In the first embodiment, a reduction in the meter-out pressure loss is effected by controlling the opening area of solely the meter-out restrictor 23*a* in the flow control valve 31 in accordance with the magnitude of the negative load, whereas the main feature of the present embodiment lies in the fact that the reduction in the meter-out pressure loss is effected by controlling the sum total of the opening area of the meter-out restrictor 23*a* in the control valve 31 and the opening area of the meter-out restrictor 52*a* in the meter-out control valve 52 in accordance with the magnitude of the negative load. In the present embodiment, the sum total of the opening areas of the two restrictors 23*a* and 52*a* is controlled by varying the opening area of the meter-out restrictor 52*a* in accordance with the magnitude of the negative load.

FIG. 7 shows the opening area characteristics of the meter-out restrictor 52*a* and the meter-out restrictor 23*a*, that is, the relationship between the stroke (spool position) and the opening area of the meter-out control valve 52 and the control valve 31. In the drawing, the solid line A indicates the opening area characteristic of the meter-out restrictor 52*a* when the arm crowding pilot pressure is imparted to the meter-out control valve 52*a*, and the dashed line B indicates the opening area characteristic of the meter-out restrictor 23*a* when the arm crowding pilot pressure is imparted to the control valve 31. The dotted line C indicates the total opening area characteristic of the meter-out restrictor 52*a* and the meter-out restrictor 23*a*.

The hydraulic control system of the construction machine according to the second embodiment of the present invention has, as the characteristic construction thereof, the pressure sensor 41 detecting the pressure of the bottom side hydraulic chamber of the arm cylinder 4, the pressure sensor 42 detecting the pressure of the rod side hydraulic chamber of the arm cylinder 4, the pressure sensor 43 detecting the arm crowding pilot pressure output from the pilot valve 6, the meter-out control valve 52 arranged in the meter-out branching-off line 51, the solenoid proportional valve 53 effecting the switching of the spool position of the meter-out control valve 52, and the controller 45 inputting the detection signals of the pressure sensor 41, the pressure sensor 42, and the pressure sensor 43, performing predetermined computation processing, and outputting a command electric current to the solenoid proportional valve 53.

Figure 8:
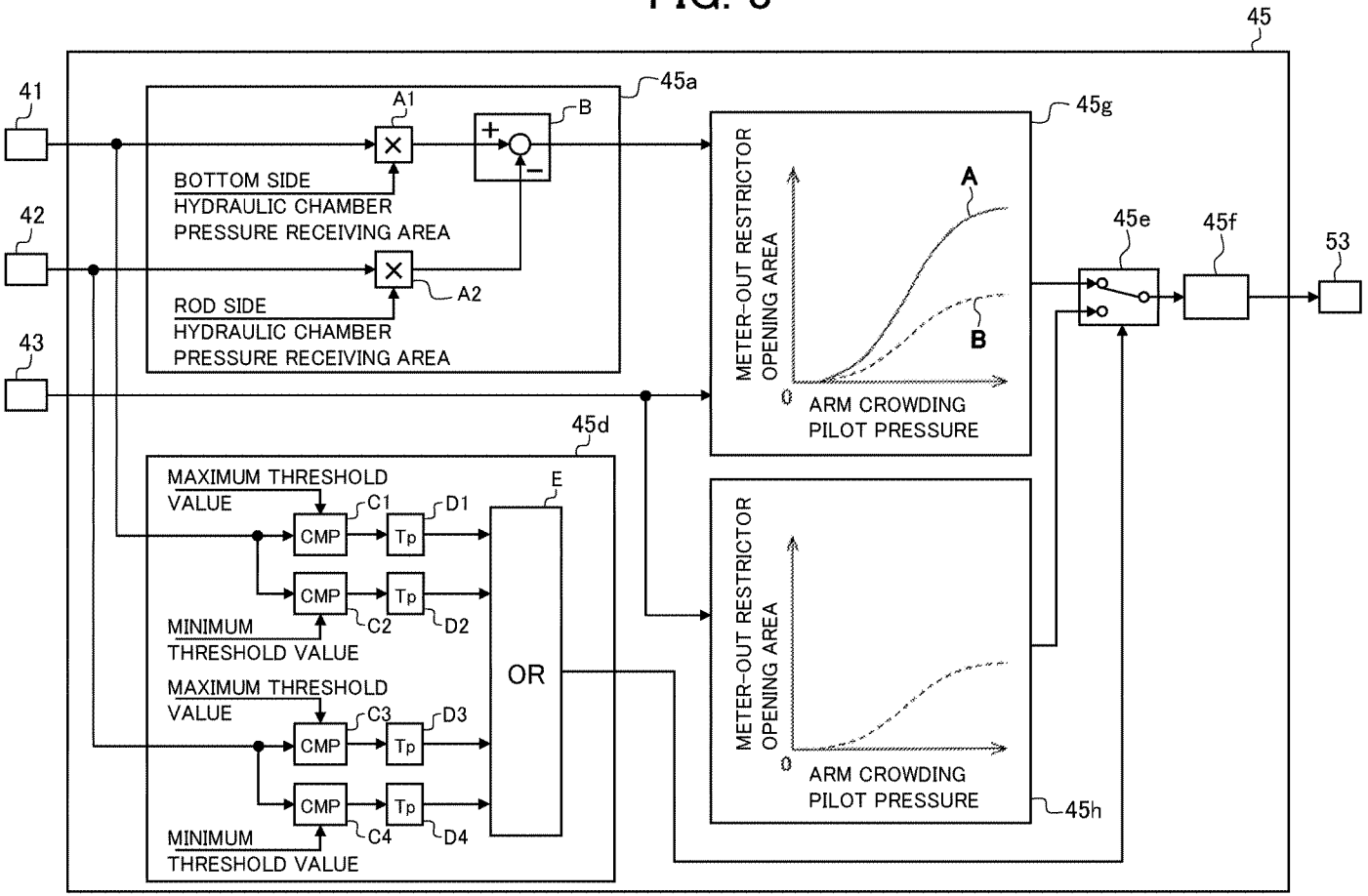
FIG. 8 is a functional block diagram illustrating the processing function of a controller constituting the hydraulic control system of the construction machine according to the second embodiment of the present invention.

Next, the processing by the controller according to the present embodiment will be described with reference to FIG. 8. FIG. 8 is a functional block diagram illustrating the processing function of a controller constituting the hydraulic control system of the construction machine according to the second embodiment of the present invention. In FIG. 8, the portions that are the same as those of FIGS. 1 through 7 are indicated by the same reference numerals, and a detailed description thereof will be left out.

The controller 45 is equipped with an arm cylinder load computation section 45*a*, a third meter-out opening computation section 45*g*, a fourth meter-out opening computation section 45*h*, a cylinder pressure sensor failure detection section 45*d*, an output selection section 45*e*, and a solenoid electric current computation section 45*f*. The arm cylinder load computation section 45*a*, the cylinder pressure sensor failure detection section 45*d*, the output selection section 45*e*, and the solenoid electric current computation section 45*f* are the same as those of the first embodiment, so a description thereof will be left out. The third meter-out opening computation section 45*g* and the fourth meter-out opening computation section 45*h* differ from those of the first embodiment solely in the table setting thereof.

In the table of the third meter-out opening computation section 45*g*, there is set a characteristic increasing the target opening area of the meter-out restrictor 52*a* as the arm crowding pilot pressure is increased, and the characteristic A indicated by the solid line indicates the characteristic (maximum value) of the target opening area signal of the meter-out restrictor 52*a* in accordance with the arm crowding pilot pressure when the load signal of the arm cylinder 4 calculated by the arm cylinder load computation section 45*a* is positive. When the load signal is positive, this characteristic does not depend on the magnitude thereof. On the other hand, the characteristic B indicated by the dashed line indicates the characteristic (minimum value) of the target opening area signal of the meter-out restrictor 52*a* in accordance with the arm crowding pilot pressure when the load signal of the arm cylinder 4 calculated by the arm cylinder load computation section 45*a* is negative and the absolute value thereof is maximum.

In the table of the fourth meter-out opening computation section 45*h*, there is set a characteristic increasing the target opening area of the meter-out restrictor 52*a* as the arm crowding pilot pressure is increased, and the characteristic of this table is the same as the characteristic B of the third meter-out opening computation section 45*g*, and indicates the characteristic (minimum value) of the target opening area signal of the meter-out restrictor 52*a* in accordance with the arm crowding pilot pressure.

Figure 9:
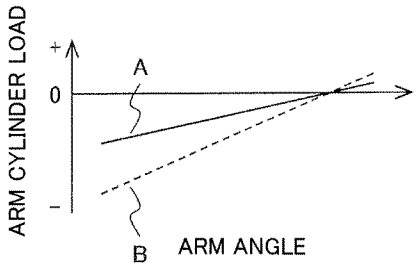
FIG. 9 is a characteristic chart illustrating the relationship between an arm angle and a load acting on an arm cylinder when crowding is performed on the arm in the air from an angle close to the horizontal direction with respect to the ground to the vertical direction in the hydraulic control system of the construction machine according to the second embodiment of the present invention.

Next, the operation of the hydraulic control system of the construction machine according to the second embodiment of the present invention will be described with reference to FIGS. 9 and 10. FIG. 9 is a characteristic chart illustrating the relationship between an arm angle and a load acting on an arm cylinder when crowding is performed on the arm in the air from an angle close to the horizontal direction with respect to the ground to the vertical direction in the hydraulic control system of the construction machine according to the second embodiment of the present invention, and FIG. 10 is a characteristic chart illustrating the relationship between the arm angle and the target opening area of the meter-out restrictor 52*a* when crowding is performed on the arm in the air from an angle close to the horizontal direction with respect to the ground to the vertical direction in the hydraulic control system of the construction machine according to the second embodiment of the present invention.

First, the operation in the case where the pressure sensors 41 and 42 are in the normal condition will be described. When the pressure sensors 41 and 42 are in the normal condition, no switching signal is output to the output selection section 45*e* from the cylinder pressure sensor failure detection section 45*d*, so that the target opening area calculated by the third meter-out opening computation section 45*g* is output from the output selection section 45*e* to the solenoid electric current computation section 45*f*, and the solenoid electric current computation section 45*f* calculates the solenoid electric current value in accordance with the input value to control the solenoid proportional valve 53.

In FIG. 9, the characteristic A indicated by the solid line indicates the load of the arm cylinder 4 in the case where a standard bucket is attached, and the characteristic B indicated by the dashed line indicates the load of the arm cylinder 4 in the case where an attachment heavier than the standard bucket is attached. In both cases, in the state in which the arm angle is close to 0 degrees (horizontal), the load of the arm cylinder is a negative load due to the weight of the arm 312 and of the attachment. As the arm angle approaches vertical, the absolute value of the negative load is reduced, and the load becomes positive at an angle close to vertical.

Figure 10:
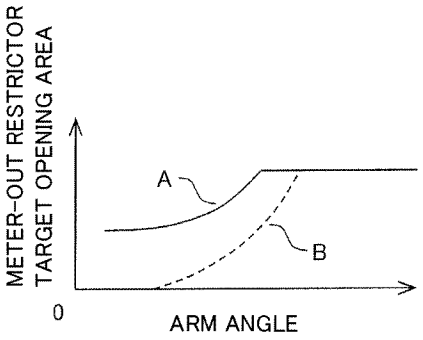
FIG. 10 is a characteristic chart illustrating the relationship between the arm angle and the target opening area of a meter-out restrictor 52*a* when crowding is performed on the arm in the air from an angle close to the horizontal direction with respect to the ground to the vertical direction in the hydraulic control system of the construction machine according to the second embodiment of the present invention.

FIG. 10 shows the relationship between the arm angle at this time and the target opening area signal of the meter-out restrictor 52*a* calculated by the third meter-out opening computation section 45*g* of the controller 45. In FIG. 10, the characteristic A indicated by the solid line indicates the target opening area of the meter-out restrictor 52*a* in the case where the standard bucket is attached, and the characteristic B indicated by the dashed line indicates the target opening area of the meter-out restrictor 52*a* in the case where an attachment heavier than the standard bucket is attached.

In the case where the standard bucket is attached, in the state in which the arm angle is close to 0 degrees (horizontal), the target opening area of the meter-out restrictor 52*a* is restricted, whereas, as the arm angle approaches vertical, it increases, and attains a maximum value. In the case where an attachment heavier than the standard bucket is attached, in the state in which the arm angle is close to 0 degrees (horizontal), the target opening area of the meter-out restrictor 52*a* is minimum, whereas, as the arm angle approaches vertical, it increases, and attains a maximum value. Based on the above, the sum total of the opening areas of the meter-out restrictors 52*a* and 23*a* is varied within the range indicated by the dashed line B and the dotted line C in FIG. 7.

In this way, in the present embodiment, the sum total of the opening areas of the meter-out restrictors 52*a* and 23*a* is varied in accordance with the load of the arm cylinder 4, so that, as in the first embodiment, it is possible to reduce the meter-out pressure loss, and also to reduce the energy loss.

Next, the case where a failure or an abnormal condition has arisen in one or both of the pressure sensors 41 and 42 will be described.

When the pressure sensor 41 or 42 or both of them are out of order of in an abnormal condition, a switching signal is output to the output selection section 45*e* from the cylinder pressure sensor failure detection section 45*d*, and the target opening area calculated by the fourth meter-out opening computation section 45*h* is output from the output selection section 45*e* to the solenoid electric current computation section 45*f*, with the solenoid electric current computation section 45*f* calculating a solenoid electric current value in accordance with the input value to control the solenoid proportional valve 53.

In the table of the fourth meter-out opening computation section 45*h*, there is set the characteristic (minimum value) of the target opening area signal of the meter-out restrictor 52*a* in accordance with the arm crowding pilot pressure which is the same as the characteristic B of the third meter-out opening computation section 45*g*, so that even under a condition in which the absolute value of the negative load acting on the arm cylinder 4 is maximum, for example, even when the arm to which a heavy attachment is attached assumes an attitude close to horizontal with respect to the ground, the opening area of the meter-out restrictor 52*a* is reduced to the requisite opening area for supporting a negative load, so that no breathing phenomenon arises.

In this way, when a failure or an abnormal condition arises in one or both of the pressure sensors 41 and 42, the opening area of the meter-out restrictor 52*a* is controlled based on the operation amount of the operation lever 36, so that it is possible to prevent deterioration in operability when a negative load acts on the arm cylinder 4.

In the hydraulic control system of the construction machine according to the second embodiment of the present invention described above, it is possible to attain the same effect as that of the first embodiment described above.

While in the above-described embodiments the present invention is applied to the valve device of the arm cylinder 4 of a hydraulic excavator, this should not be construed restrictively. For example, the same problem is involved in the bucket crowding operation of a hydraulic excavator, and the present invention may be applied to the valve device of the bucket cylinder. In this case, for example, in the hydraulic circuit shown in FIGS. 2 and 6, the arm cylinder 4 is replaced by a bucket cylinder, the control valve 31 for the arm is replaced by a control valve for the bucket, and the operation lever device 6 for the arm is replaced by an operation lever device for the bucket.

Further, so long as various negative loads, large and small, act on the hydraulic actuator, the present invention is also applicable to the valve device of a hydraulic actuator other than the arm cylinder or the bucket cylinder of a hydraulic excavator, or to the valve device of a hydraulic actuator of a construction machine other than the hydraulic excavator (e.g., a wheel loader or a crane).

Further, the present invention is not restricted to the above-described embodiments but includes various modifications without departing from the scope of the gist of the invention. For example, the present invention is not restricted to a system equipped with all the components described in connection with the above embodiments but includes a system in which part of the components are omitted. Further, part of the components related to a certain embodiment may be added to or replace the components related to another embodiment.

DESCRIPTION OF REFERENCE CHARACTERS

1: Prime mover
2: Hydraulic pump
2*a*: Displacement volume varying member (swash plate)
2*b*: Horsepower control actuator
3: Delivery line
4: Arm cylinder
5: Valve device
6: Pilot valve
21: Center bypass portion
22*a*: Meter-in restrictor
22*b*: Meter-in restrictor
23*a*: Meter-out restrictor
23*b*: Meter-out restrictor
31: Control valve
31*e*, 31*f*: Pressure receiving portion
32: Center bypass line
33: Tank
34, 35: Actuator line
36: Operation lever
37: Pilot pressure generating portion
38, 39: Pilot line
41: Pressure sensor
42: Pressure sensor
43: Pressure sensor
44: Solenoid proportional valve
45: Controller
45*a*: Arm cylinder load computation section
45*b*: First meter-out opening computation section
45*c*: Second meter-out opening computation section
45*d*: Cylinder pressure sensor failure detection section
45*e*: Output selection section
45*f*: Solenoid electric current computation section
45*g*: Third meter-out opening computation section
45*h*: Fourth meter-out opening computation section
51: Branching-off line
52: Meter-out control valve
52*a*: Meter-out restrictor
52*b*: Pressure receiving portion
53: Solenoid proportional valve
54: Signal pressure line
300: Operation device
312: Arm
314: Bucket (attachment)
315: Bucket cylinder

The invention claimed is:

1. A hydraulic control system of a construction machine comprising:

a hydraulic actuator driven by a hydraulic fluid delivered from a hydraulic pump;

one or a plurality of meter-out flow lines through which the hydraulic fluid discharged from the hydraulic actuator flows;

one variable restrictor provided in the one meter-out flow line, or a plurality of variable restrictors each provided in the plurality of meter-out flow lines;

an operation device outputting an operation command signal for the hydraulic actuator in accordance with an operation amount;

an operation amount sensor detecting an operation amount of the operation device;

a load sensor detecting a magnitude of a negative load which is a load applied to the hydraulic actuator by an external force and which is a load in the same direction as an operating direction of the hydraulic actuator;

a load abnormality sensor detecting a failure or an abnormal condition of the load sensor; and a control device which, when the load abnormality sensor does not detect a failure or an abnormal condition of the load sensor, reduces an opening area of the one variable restrictor provided in the one meter-out flow line or the sum total of the opening areas of the plurality of variable restrictors each provided in the plurality of meter-out flow lines in accordance with an increase in the magnitude of a negative load detected by the load sensor and the operation amount detected by the operation amount sensor and which, when the load abnormality sensor detects a failure or an abnormal condition of the load sensor, reduces the opening area of the one variable restrictor or a sum total of the opening areas of the plurality of variable restrictors to a predetermined value in accordance with the operation amount detected by the operation amount sensor;

wherein there exist an upper limit value and a lower limit value for each operation amount of the operation device in a range in which the opening area of the one variable restrictor or the sum total of the opening areas of the plurality of variable restrictors is varied in accordance with an increase in the magnitude of the negative load detected by the load sensor; and when the load abnormality sensor detects a failure or an abnormal condition of the load sensor, the opening area of the one variable restrictor or the sum total of the opening areas of the plurality of variable restrictors is reduced to a lower limit value existing for each operation amount of the operation device.

2. The hydraulic control system of a construction machine according to claim 1, wherein the hydraulic actuator is an arm cylinder driving an arm of a hydraulic excavator, or a bucket cylinder driving a bucket.

3. The hydraulic control system of a construction machine according to claim 1, further comprising: a control valve controlling a supply and discharge of the hydraulic fluid with respect to the hydraulic actuator in accordance with a spool position, wherein the one meter-out flow line is a first flow line through which the hydraulic fluid discharged from the hydraulic actuator flows when the hydraulic actuator operates in the same direction as the negative load, the first flow line passing through the control valve;

the one variable restrictor is a first variable restrictor provided in the control valve in the first flow line; and the control device reduces the opening area of the first variable restrictor by changing the spool position of the control valve in accordance with an increase in the magnitude of the negative load detected by the load sensor and with an operation amount detected by the operation amount sensor.

4. The hydraulic control system of a construction machine according to claim 1, further comprising: a control valve controlling a supply and discharge of the hydraulic fluid with respect to the hydraulic actuator in accordance with a spool position, wherein the plurality of meter-out flow lines include a first flow line through which the hydraulic fluid discharged from the hydraulic actuator flows when the hydraulic actuator operates in the same direction as the negative load, the first flow line passing through the control valve, and a second flow line through which the hydraulic fluid discharged from the hydraulic actuator flows when the hydraulic actuator operates in the same direction as the negative load;

the plurality of variable restrictors include a first variable restrictor provided in the control valve in the first flow line and increasing in opening area with an increase in the operation amount of the operation device, and a second variable restrictor provided in the second flow line and increasing in opening area with an increase in a pilot pressure output from a hydraulic fluid source; and the control device reduces the sum total of the opening areas of the first variable restrictor and the second variable restrictor by reducing the opening area of the second variable restrictor in accordance with an increase in the magnitude of the negative load detected by the load sensor and with the operation amount detected by the operation amount sensor.

* * * * *